US006152316A

United States Patent [19]

Niese

[11] Patent Number: 6,152,316

[45] Date of Patent: Nov. 28, 2000

[54] TAMPER-INDICATING CLOSURE AND METHOD OF MANUFACTURE

[75] Inventor: Richard B. Niese, Maumee, Ohio

[73] Assignee: Owens-Illinois Closure Inc., Toledo, Ohio

[21] Appl. No.: 09/312,096

[22] Filed: May 17, 1999

[51] Int. Cl.[7] ..... B65D 41/34

[52] U.S. Cl. ..... 215/252

[58] Field of Search ..... 215/252

[56] References Cited

U.S. PATENT DOCUMENTS

| | | | |
|---|---|---|---|
| Re. 33,265 | 7/1990 | Gregory et al. . | |
| 3,297,184 | 1/1967 | Andelin . | |
| 3,329,295 | 7/1967 | Fields . | |
| 3,374,913 | 3/1968 | Zipper . | |
| 3,438,582 | 4/1969 | Fields . | |
| 3,484,012 | 12/1969 | White et al. . | |
| 3,784,041 | 1/1974 | Birch . | |
| 3,858,743 | 1/1975 | Mumford . | |
| 3,861,551 | 1/1975 | Hannon . | |
| 4,126,240 | 11/1978 | Brach . | |
| 4,147,268 | 4/1979 | Patel et al. . | |
| 4,157,144 | 6/1979 | Weiler et al. . | |
| 4,196,818 | 4/1980 | Brownbill . | |
| 4,206,851 | 6/1980 | Ostrowsky . | |
| 4,291,813 | 9/1981 | Allen et al. . | |
| 4,305,516 | 12/1981 | Perné et al. . | |
| 4,322,009 | 3/1982 | Mumford . | |
| 4,394,918 | 7/1983 | Grussen . | |
| 4,401,227 | 8/1983 | Pehr . | |
| 4,432,461 | 2/1984 | Mumford et al. . | |
| 4,458,821 | 7/1984 | Ostrowsky . | |
| 4,458,822 | 7/1984 | Ostrowsky . | |
| 4,470,513 | 9/1984 | Ostrowsky . | |
| 4,478,343 | 10/1984 | Ostrowsky . | |
| 4,506,795 | 3/1985 | Herr . | |
| 4,576,298 | 3/1986 | Boik . | |
| 4,657,153 | 4/1987 | Hayes | 215/252 |
| 4,801,031 | 1/1989 | Barriac . | |
| 4,875,594 | 10/1989 | Ochs . | |
| 4,895,266 | 1/1990 | Begley . | |
| 4,978,016 | 12/1990 | Hayes . | |
| 4,981,230 | 1/1991 | Marshall et al. . | |
| 5,007,545 | 4/1991 | Imbery, Jr. . | |
| 5,058,755 | 10/1991 | Hayes . | |

(List continued on next page.)

FOREIGN PATENT DOCUMENTS

| | | | |
|---|---|---|---|
| 0049876 | 4/1982 | European Pat. Off. . | |
| 2291915 | 11/1974 | France . | |
| 2421812 | 11/1979 | France . | |
| 2213773 | 3/1972 | Germany . | |
| 3025751 | 2/1982 | Germany . | |
| 57126340 | 1/1956 | Japan . | |
| 62146162 | 5/1987 | Japan . | |
| 61244757 | 10/1988 | Japan . | |
| 1107557 | 7/1989 | Japan . | |
| 4215964 | 8/1992 | Japan . | |
| 10119999 | 5/1996 | Japan . | |
| 9226790 | 9/1997 | Japan . | |
| 10-152156 | 6/1998 | Japan | 215/252 |
| 2034674 | 6/1980 | United Kingdom . | |

*Primary Examiner*—Nathan J. Newhouse

[57] ABSTRACT

A tamper-indicating closure of integrally molded plastic construction that includes a base wall having a peripheral skirt with an internal thread for engaging corresponding external means on a container finish to retain the closure on the finish. A tamper-indicating band is connected to an edge of the skirt by a plurality of spaced integral frangible bridges. A stop flange extends axially and radially from an edge of the band remote from the skirt, being flexibly connected to the band by an integral hinge portion. A plurality of circumferentially spaced openings extend axially through the band adjacent to the hinge portion, forming drain openings through which fluid may drain after the closure is applied to a wet container finish. In the preferred embodiments of the invention, these drain openings are formed by a plurality of circumferentially spaced channels on the radially inner surface of the band extending axially from adjacent to the frangible means to open at an axial edge of the band remote from the frangible means.

15 Claims, 2 Drawing Sheets

U.S. PATENT DOCUMENTS 5,282,540 2/1994 Beck .
5,400,913 3/1995 Kelly .
5,462,187 10/1995 Gregory et al. .
5,472,106 12/1995 Nofer .
5,488,888 2/1996 Kowal .
5,522,293 6/1996 Ingram .
5,564,319 10/1996 Kowal .
5,570,798 11/1996 Hayashida et al. .
5,650,113 7/1997 Gregory et al. .
5,678,714 10/1997 Guglielmini .
5,685,443 11/1997 Taber et al. ..... 215/252
5,725,115 3/1998 Bösl et al. .
5,727,705 3/1998 Kelly .
5,755,347 5/1998 Ingram .
5,775,527 7/1998 Bösl et al. .

TAMPER-INDICATING CLOSURE AND METHOD OF MANUFACTURE

The present invention relates to tamper-indicating closures, to methods of manufacturing such closures, and to a package that includes such a closure on a container.

BACKGROUND AND OBJECTS OF THE INVENTION

It is conventional to form a tamper-indicating closure having a band connected to the skirt of the closure by integral frangible means, such as frangible bridges or a frangible web. The band has a stop element (e.g., a flange or bead) that engages a bead on the container to resist unthreading of the closure, so that removal of the closure ruptures the frangible means that connect the band to the closure skirt. U.S. Pat. No. Re 33,265, 4,322,009 and 4,432,461, assigned to the assignee hereof, disclose tamper-indicating closures of this character, in which the tamper-indicating band is completely severed from the closure skirt and remains with the container upon removal of the closure from the container. U.S. Pat. No. 5,295,600, also assigned to the assignee hereof, discloses a tamper-indicating closure in which the tamper-indicating band remains connected to the closure skirt and is removed from the container with the closure.

Although tamper-indicating closures of the types disclosed in the noted patents have enjoyed substantial commercial acceptance and success in the art, further improvements remain desirable. For example, problems are encountered when employing this type of closure in so-called wet finish applications, in which liquid may spill during or after the filling operation onto the outside surface of the container finish so as to be disposed between the container finish and the closure skirt after capping. Wet finish situations of this type are encountered during hot fill, cold-fill and aseptic-fill situations, in which the containers are filled close to the brim or to overflow prior to capping. Wet finish situations can also be encountered during filling operations in which liquid may drip from the filling machinery onto the container finish. In wet-finish situations of this type, problems are encountered in connection with draining and drying of the area between the outer surface of the container finish and the closure skirt—i.e., between the threads on the container finish and skirt, and around the tamper-indicating band and the stop element. Liquid trapped within this area can result in growth of mold and mildew. This drainage problem is particularly exacerbated in situations in which the self-resiliency of the closure biases the stop flange into opposed engagement with the so-called A1 diameter of the container finish. While wet finish applications are not usually recommended by closure manufacturers because of the potential for entrapment of product in the closure threads and the consumer problems that result therefrom, the present invention will help alleviate the potential for product entrapment when the product filler finds it necessary to use such a filling process.

It is a general object of the present invention to provide a closure and a method of manufacturing a closure that facilitate both drainage of liquid products after capping and improved air flow between the closure and container finish for drying after capping. Another and related object of the present invention is to provide a closure and method of manufacture that achieve the foregoing objectives while retaining the advantages of the closures disclosed in the above-noted patents in terms of ease of application to the container finish after filling (lower top load and lower temperature) and whole or partial rupture of the tamper-indicating band from the closure skirt to provide the tamper-indicating feature. Yet another object of the present invention is to provide a package, which includes a closure and a container, that is particularly well adapted for use in conjunction with wet finish applications as described.

SUMMARY OF THE INVENTION

A tamper-indicating closure of integrally molded plastic construction in accordance with presently preferred embodiments of the invention includes a base wall having a peripheral skirt with internal means, such as a thread or bead, for engaging corresponding external means on a container finish to retain the closure on the finish. A tamper-indicating band is connected to an edge of the skirt by frangible means, such as a plurality of spaced integral frangible bridges or an integral frangible web. A stop flange extends axially and radially from an edge of the band remote from the skirt, being flexibly connected to the band by an integral hinge portion. A plurality of circumferentially spaced openings extend axially through the band adjacent to the hinge portion, forming drain openings through which fluid may drain after the closure is applied to a wet container finish. In the preferred embodiments of the invention, these drain openings are formed by a plurality of circumferentially spaced channels on the radially inner surface of the band extending axially from adjacent to the frangible means to open at an axial edge of the band remote from the frangible means.

The hinge portion of the stop flange in the preferred embodiments of the invention is integrally joined to the tamper-indicating band at a radially inner edge of the band. In one embodiment of the invention, the drain openings are formed entirely in the tamper-indicating band, and do not extend into the hinge portion of the stop flange. In another preferred embodiment of the invention, the drain openings extend radially into the hinge portion of the flange to increase the effective radial dimension of the drain openings. The stop flange in the preferred embodiments of the invention is thinnest at the hinge portion, and thickens radially and axially toward a free edge of the flange spaced from the band. In accordance with another aspect of the invention, the stop flange has a plurality of circumferentially spaced channels adjacent to such free edge and radially aligned with the drain openings in the tamper-indicating band such that, when the stop flange is folded against the band, the channels in the stop flange and the openings in the band form continuous substantially axial passages between the flange and the band, and through the band.

A second aspect of the invention comprises a method of making a tamper-indicating closure by integrally molding a closure of plastic as-molded construction that includes a base wall with a peripheral skirt and a tamper-indicating band connected by frangible means to an edge of the skirt. A stop flange extends axially and radially from an edge of the band remote from the skirt, and is flexibly connected to the band by an integral hinge portion. A plurality of circumferentially spaced openings extend axially through the band adjacent to the hinge portion, and are preferably formed by a plurality of circumferentially spaced channels that extend axially from adjacent to the frangible means to open at an axial edge of the band remote from the frangible means. A package, in accordance with a third aspect of the invention, comprises a container having a finish with an external thread and an external bead disposed beneath the thread, and a tamper-indicating closure as described above.

BRIEF DESCRIPTION OF THE DRAWINGS

The invention, together with additional objects, features and advantages thereof, will be best understood from the following description, the appended claims and the accompanying drawings in which:

DETAILED DESCRIPTION OF PREFERRED EMBODIMENTS

Figure 1:
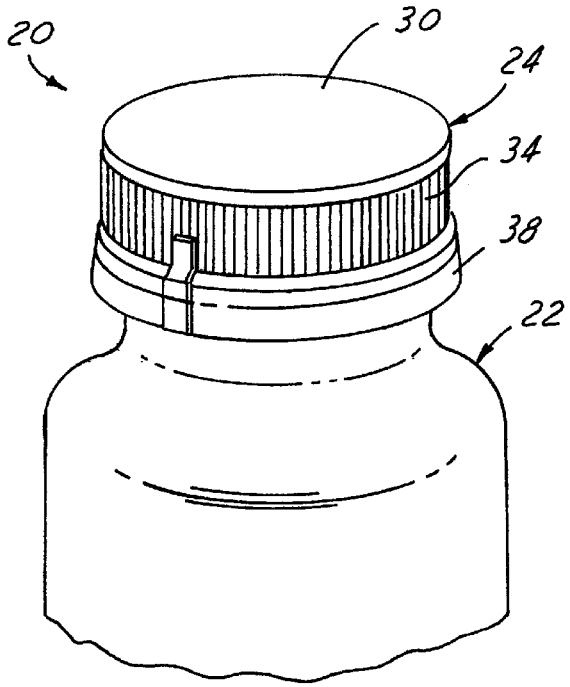
FIG. 1 is a fragmentary perspective view of a container and closure package in accordance with a presently preferred embodiment of the invention.
Figure 2:
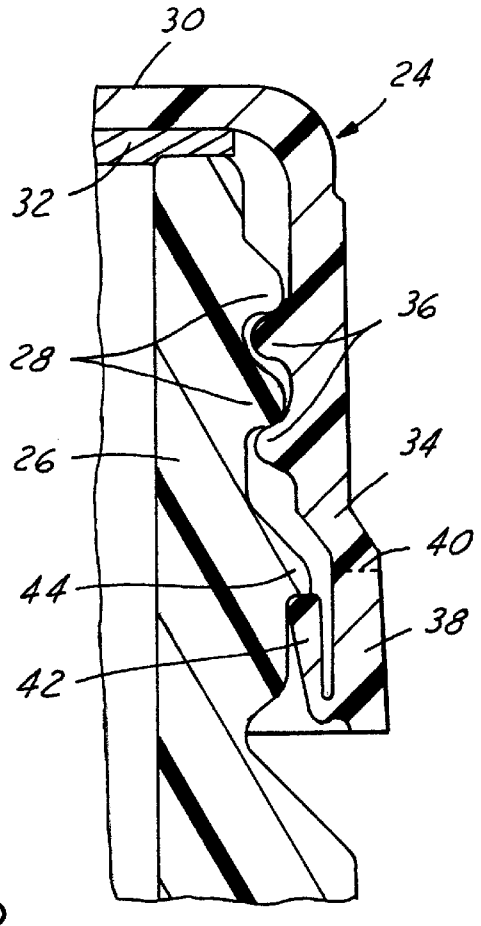
FIG. 2 is a fragmentary sectional view that illustrates the container finish and closure in the package of FIG. 1.
Figure 3:
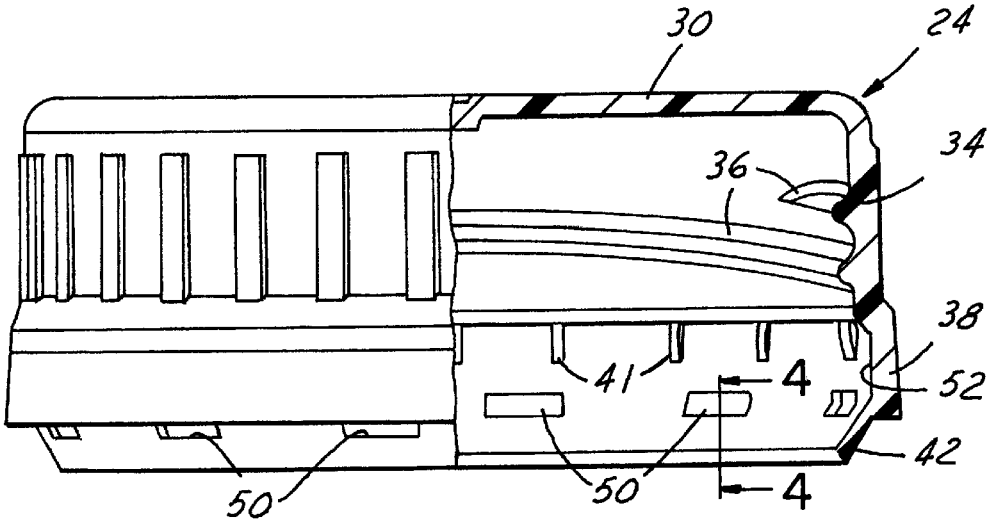
FIG. 3 is a partially sectioned side elevational view of the closure in the package of FIGS. 1 and 2 as molded—i.e., before stop flange inversion.

FIGS. 1–4A illustrate a package 20 in accordance with one presently preferred embodiment of the invention as comprising a container 22 of glass or molded plastic construction and a tamper-indicating closure 24 threaded thereon. Container 22 has an axially extending finish 26 for receiving closure 24. Closure 24 has a flat base wall 30 on which a sealing liner 32 is secured. An annular peripheral skirt 34 extends downwardly from closure base wall 30, and has at least one internal thread 36 for securing closure 24 over at least one external thread 28 of container 22. (Directional descriptors such as "downwardly" are taken with reference to the vertical orientation of the container and closure illustrated in FIGS. 1 and 2.) A tamper-indicating band 38 is secured to the lower end of skirt 34, being separated therefrom by frangible means 40. Tamper-indicating band 38 is thus coupled to closure skirt 34 in the illustrated embodiment by a circumferentially spaced array of frangible bridges 41 (FIGS. 2 and 3). Bridges 41 may be formed during a scoring operation, as described in the patents referenced hereinafter. Alternatively, the bridges may be molded onto the inside surface of skirt 34 and band 38, as shown in U.S. Pat. Nos. 4,407,422 and 4,418,828. Alternatively, but less preferably, band 38 may be connected to skirt 34 by a thin frangible web integrally molded with the closure. A stop flange 42 extends radially inwardly and axially upwardly (FIG. 2) from the lower end of band 38 to a position beneath a radially outwardly extending bead 44 on container 22 beneath thread 28. Bead 44 is sometimes called the container transfer bead or the "A" bead, referring to the fact that bead 44 defines the "A" dimension of the container finish. Stop flange 42 preferably thickens radially inwardly from band 38, being thinnest at the integral flexible juncture with band 38 and thickest at the free edge that abuts the container bead.

Closure 24 may be injection molded as shown or compression molded as taught in U.S. Pat. No. 5,554,327. Liner 32 may be separately formed, or more preferably compression molded in situ within a preformed closure as disclosed in U.S. Pat. Nos. 4,984,703 and 5,451,360. U.S. Pat. Nos. 5,488,888, 5,522,203 and 5,564,319 disclose techniques for forming bridges 41 in a scoring operation. U.S. Pat. Nos. 5,755,347 and Re 33,265 disclose techniques for inverting stop flange 42 from the as-molded configuration of FIGS. 3 and 4 to the configuration of FIGS. 2 and 4A ready for use. All patents noted herein, assigned to the assignee hereof, are incorporated herein by reference for purposes of background.

Figure 4:
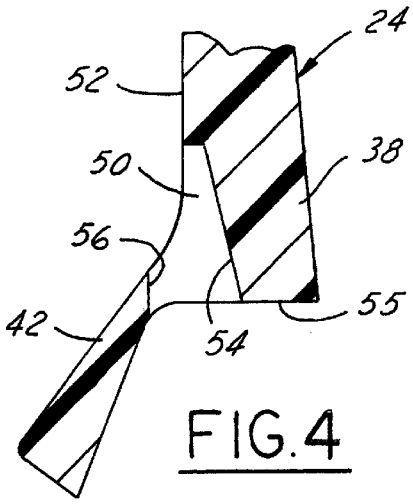
FIG. 4 is a fragmentary sectional view taken substantially along the line 4—4 in FIG. 3.

FIGS. 3–4 illustrate closure 24 as molded, before inversion of stop flange 42, formation of score line 40 and molding of liner 32. A circumferential array of axial drain openings 50 are formed in tamper-indicating band 38. More specifically, tamper-indicating band preferably has a circumferentially continuous substantially cylindrical radially inner surface 52, and openings 50 are formed at least in part by a circumferential array of channels 54 formed in surface 52. Each channel 54 extends axially from an upper end that begins beneath the position of frangible means 40 (FIG. 2) to a lower end at which channel 54 opens at the lower edge 55 of tamper-indicating band 38. Channels 54 increase in radial depth from the upper end to the lower end, both to facilitate drainage of liquid and to facilitate manufacture by easing removal of mold die components. In the preferred embodiment of the invention illustrated in FIGS. 3–4A, openings 50 also extend radially at 56 into stop flange 42. Stop flange 42 is integrally connected by a flexible hinge portion to the radially inner edge of stop band edge 55, and the combination of opening channels 54 and portions 56 form substantially rectangular drain openings 50, as best seen in FIG. 3.

In a 48 mm embodiment of the invention illustrated in FIGS. 1–4A, there are twelve equally spaced drain openings 50, each having a circumferential dimension of about 0.183 inches. Channels 54 in band 38 have an axial dimension of 0.060 inches and a radial dimension of about 0.022 inches. The total radial dimension of openings 50 at lower edge 55 of band 38 is 0.052 inches. Thus, opening portion 56 extends 0.030 inches into the hinge portion of stop flange 42. These dimensions are all nominal, and are given by way of example only. These dimensions may vary for closures of different design and size. For example, an exemplary 33 mm closure has fourteen equally spaced openings 50 of 0.060 inches circumferential dimension and 0.050 inches radial dimension. A 43 mm closure has eighteen equally spaced openings 50 of 0.060 inches circumferential dimension and 0.035 inches radial dimension. A 38 mm example and a 40 mm example have sixteen equally spaced openings of 0.060 inches circumferential dimension, and 0.049 and 0.050 inches radial dimension.

Figure 4A:
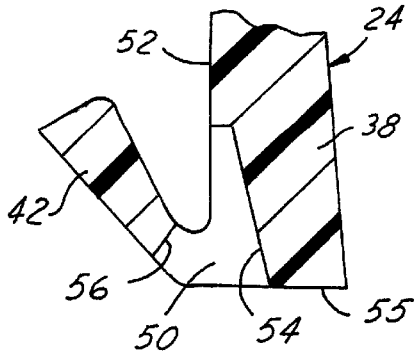
FIG. 4A is a fragmentary sectional view similar to that of FIG. 4 but showing the stop flange after inversion.
Figure 5:
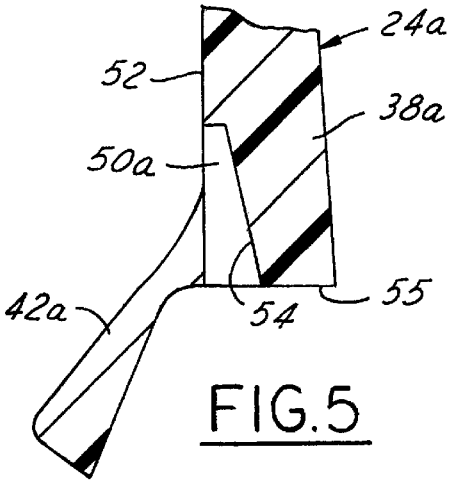
FIGS. 5 and 5A are fragmentary sectional views respectively similar to those of FIGS. 4 and 4A, but illustrating a modified embodiment of the invention.
Figure 5A:
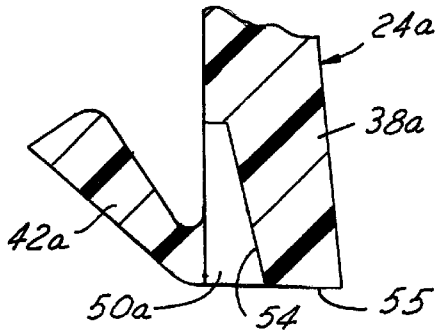

FIGS. 5 and 5A illustrate a modified closure 24*a*, in which drain openings 50*a* are formed entirely within tamper-indicating band 38*a*—i.e., by channels 54 in surface 52 of band 38*a*. Openings 50*a* do not extend radially inwardly into stop flange 42*a*. Otherwise, closure 24*a* in FIGS. 5 and 5A is identical to closure 24 of FIGS. 4 and 4A.

Figure 6:
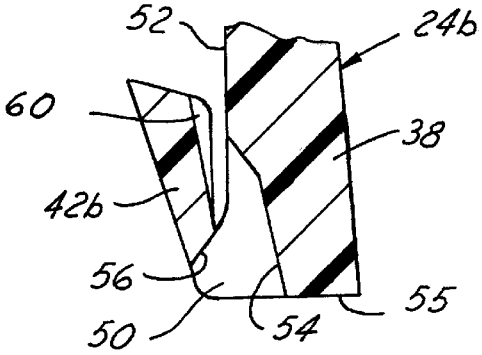
FIG. 6 is a fragmentary sectional view similar to that of FIG. 4A but illustrating another modified embodiment of the invention.
Figure 7:
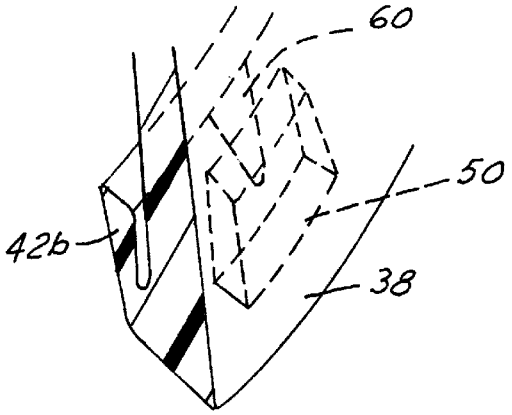
FIG. 7 is a fragmentary perspective view of the embodiment of the invention illustrated in FIG. 6.

FIGS. 6 and 7 illustrate a modification to the embodiment of FIGS. 1–4A, in which closure 24*b* has drain openings 50 as in FIGS. 3–4A. Stop flange 42*b* is provided with a circumferential array of channels 60 on the surface thereof that opposes surface 52 of band 38 after inversion. Channels 52 are axially and radially aligned with drain openings 50, and thus cooperate with the drain openings to enhance drainage of liquid from a wet container finish above stop flange 42*b*. That is, channels 60 effectively extend the length of drain openings axially upwardly, and enhance drainage of the liquid between the stop flange and the tamper-indicating band.

There have thus been disclosed a closure package and method of manufacture that fully achieve the objects and aims previously set forth. Several modifications and variations have been disclosed. Other modifications and variations will readily suggest themselves to persons skilled in the art. The invention is intended to encompass all modifications and variations that fall within the spirit and broad scope of the appended claims.

What is claimed is:

1. A tamper-indicating closure of integrally molded plastic construction, which comprises:

a base wall having a peripheral skirt with internal means for affixing the closure to a container, a tamper-indicating band connected by frangible means to an edge of said skirt, a stop flange extending axially and radially from an edge of said band remote from said skirt, said stop flange including a hinge portion flexibly connecting said flange to said band, and a plurality of circumferentially spaced openings extending axially through said band adjacent to said hinge portion of said stop flange, wherein said stop flange has a plurality of circumferentially spaced channels adjacent to said free edge and radially aligned with said openings such that, when said stop flange is folded against said band, said channels in said stop flange and said openings in said band form continuous substantially axial passages between said flange and band and through said band.

2. The closure set forth in claim 1 wherein said band has a radially inner surface, and wherein said plurality of circumferentially spaced openings comprise channels formed in said surface and extending axially from adjacent to said frangible means to open at an axial edge of said band remote from said frangible means.

3. The closure set forth in claim 2 wherein said hinge portion is integrally joined to said band at a radially inner edge of said axial edge of said band, and where in each of said openings extends radially into said hinge portion adjacent to said band.

4. The closure set forth in claim 3 wherein said stop flange is thinnest at said hinge portion, and thickens radially and axially to a free edge spaced from said band.

5. A tamper-indicating closure of integrally molded plastic construction, which comprises:

a base wall having a peripheral skirt with internal means for affixing the closure to a container, a tamper-indicating band connected by frangible means to an edge of said skirt, a stop flange extending axially outwardly and radially inwardly from an edge of said band remote from said skirt, said stop flange including a hinge portion flexibly connecting said flange to said band, and a plurality of circumferentially spaced openings extending through said band adjacent to said hinge portion of said stop flange, wherein said band has a radially inner surface, and wherein said plurality of circumferentially spaced openings comprise channels formed in said surface and extending axially from adjacent to said frangible means to open at an axial edge of said band remote from said frangible means, wherein said hinge portion is integrally joined to said band at a radially inner edge of said axial edge of said band, and wherein each of said openings extends radially into said hinge portion adjacent to said band, said stop flange being thinnest at said hinge portion, and thickening radially and axially to a free edge spaced from said band, and wherein said stop flange has a plurality of circumferentially spaced channels adjacent to said free edge and radially aligned with said openings such that, when said stop flange is folded against said band, said channels in said stop flange and said openings in said band form continuous substantially axial passages between said flange and band and through said band.

6. A method of making a tamper-indicating closure that comprises the step of:

integrally molding a closure of plastic as-molded construction that includes a base wall having a peripheral skirt with internal means for affixing the closure to a container, a tamper-indicating band connected by frangible means to an edge of said skirt, a stop flange extending axially and radially from an edge of said band remote from said skirt, said stop flange including a hinge portion flexibly connecting said flange to said band, and a plurality of circumferentially spaced openings extending axially through said band adjacent to said hinge portion of said stop flange, wherein said step of molding said closure is such that said stop flange has a plurality of circumferentially spaced channels adjacent to said free end edge and radially aligned with said openings such that, when said stop flange is folded against said band, said channels in said stop flange and said openings in said band form continuous substantially axial passages between said flange and band and through said band.

7. The method said forth in claim 6 wherein said band of said as-molded construction has a radially inner surface, and wherein said plurality of circumferentially spaced openings comprise channels formed in said surface and extending axially from adjacent to said frangible means to open at an axial edge of said band remote from said frangible means.

8. The method set forth in claim 7 wherein said step of molding said closure is selected from the group consisting of injection molding said closure and compression molding said closure.

9. The method set forth in claim 7 wherein said step of molding said closure is such that said hinge portion is integrally joined to said band at a radially inner edge of said axial edge of said band, and wherein each of said openings extends radially into said hinge portion adjacent to said band.

10. A method of making a tamper-indicating closure that comprises the step of:

integrally molding a closure of plastic as-molded construction that includes a base wall having a peripheral skirt with internal means for affixing the closure to a container, a tamper-indicating band connected by frangible means to an edge of said skirt, a stop flange extending axially and radially from an edge of said band remote from said skirt, said stop flange including a hinge portion flexibly connecting said flange to said band, and a plurality of circumferentially spaced openings extending axially through said band adjacent to said hinge portion of said stop flange, wherein said band of said as-molded construction has a radially inner surface, and wherein said plurality of circumferentially spaced openings comprise channels formed in said surface and extending axially from adjacent to said frangible means to open at an axial edge of said band remote from said frangible means, wherein said step of molding said closure is such that said hinge portion is integrally joined to said band at a radially inner edge of said axial edge of said band, and wherein each of said openings extends radially into said hinge portion adjacent to said band, and wherein said step of molding said closure is such that said stop flange has a plurality of circumferentially spaced channels adjacent to said free edge and radially aligned with said openings such that, when said stop flange is folded against said band, said channels in said stop flange and said openings in said band form continuous substantially axial passages between said flange and band and through said band.

11. A package that comprises a container having a finish with an external thread and an external bead disposed beneath said thread, and a tamper-indicating closure that includes:

a base wall having a peripheral skirt with an internal thread for securing the closure to the container finish, a tamper-indicating band connected by frangible means to an edge of said skirt, a stop flange extending axially and radially from an edge of said band remote from said skirt for abutment with the container bead, said stop flange including a hinge portion flexibly connecting said flange to said band, and a plurality of circumferentially spaced openings extending axially through said band adjacent to said hinge portion of said stop flange, wherein said stop flange has a plurality of circumferentially spaced channels adjacent to said free edge and radially aligned with said openings such that, when said stop flange is folded against said band, said channels in said stop flange and said openings in said band form continuous substantially axial passages between said flange and band and through said band.

12. The package set forth in claim 11 wherein said band has a radially inner surface, and wherein said plurality of circumferentially spaced openings comprise channels formed in said surface and extending axially from adjacent to said frangible means to open at an axial edge of said band remote from said frangible means.

13. The package set forth in claim 12 wherein said hinge portion is integrally joined to said band at a radially inner edge of said axial edge of said band, and where in each of said openings extends radially into said hinge portion adjacent to said band.

14. The package set forth in claim 13 wherein said stop flange is thinnest at said hinge portion, and thickens radially and axially to a free edge spaced from said band.

15. A package that comprises a container having a finish with an external thread and an external bead disposed beneath said thread, and a tamper-indicating closure that includes:

a base wall having a peripheral skirt with an internal thread for securing the closure to the container finish, a tamper-indicating band connected by frangible means to an edge of said skirt, a stop flange extending axially and radially from an edge of said band remote from said skirt for abutment with the container bead, said stop flange including a hinge portion flexibly connecting said flange to said band, and a plurality of circumferentially spaced openings extending axially through said band adjacent to said hinge portion of said stop flange, wherein said band has a radially inner surface, and wherein said plurality of circumferentially spaced openings comprise channels formed in said surface and extending axially from adjacent to said frangible means to open at an axial edge of said band remote from said frangible means, wherein said hinge portion is integrally joined to said band at a radially inner edge of said axial edge of said band, and wherein each of said openings extends radially into said hinge portion adjacent to said band, said stop flange being thinnest at said hinge portion, and thickening radially and axially to a free-edge spaced from said band, and wherein said stop flange has a plurality of circumferentially spaced channels adjacent to said free edge and radially aligned with said openings such that, when said stop flange is folded against said band, said channels in said stop flange and said openings in said band form continuous substantially axial passages between said flange and band and through said band.

* * * * *